United States Patent [19]

Fairlie

[11] 4,245,149

[45] Jan. 13, 1981

[54] HEATING SYSTEM FOR CHAIRS

[76] Inventor: Ian F. Fairlie, 2082 Jeanne Mance St., Montreal, Quebec, Canada, H2X 2J5

[21] Appl. No.: 28,828

[22] Filed: Apr. 10, 1979

[51] Int. Cl.[3] ..... H05B 3/34

[52] U.S. Cl. ..... 219/528; 219/545; 219/549; 219/494

[58] Field of Search ..... 219/211, 212, 217, 345, 219/528, 529, 545, 549, 491, 494

[56] References Cited

U.S. PATENT DOCUMENTS

| | | | |
|---|---|---|---|
| Re. 26,522 | 2/1969 | Fessenden | 219/528 |
| 2,613,306 | 10/1952 | Waltersdorf et al. | 219/345 |
| 2,706,768 | 4/1955 | Kaplan | 219/528 X |
| 2,719,907 | 10/1955 | Combs | 219/528 |
| 2,783,358 | 2/1957 | Wolf | 219/345 |
| 2,845,519 | 7/1958 | Willat | 219/528 |
| 2,938,992 | 5/1960 | Crump | 219/549 X |
| 2,967,415 | 1/1961 | Ford et al. | 219/212 X |
| 3,031,739 | 5/1962 | Boggs | 219/345 X |
| 3,153,140 | 10/1964 | Theodore et al. | 219/549 |
| 3,417,229 | 12/1968 | Shomphe et al. | 219/528 |
| 3,422,244 | 1/1969 | Lauck | 219/212 |
| 3,564,203 | 2/1971 | Haoi | 219/491 |

FOREIGN PATENT DOCUMENTS

| | | | |
|---|---|---|---|
| 777289 | 1/1968 | Canada | 219/212 |
| 868615 | 4/1971 | Canada | 219/491 |

OTHER PUBLICATIONS

"Volva Brochure Parts Manual", 1975 *Cigarette Lighter,* pp. 3-24 to 3-26, *Electrically Heated Driver's Seat,* pp. 3-20.

"General Electric SCR Manual", Fourth Edition, pp. 186 to 189.

*Primary Examiner*—Volodymyr Y. Mayewsky

*Attorney, Agent, or Firm*—Melvin Sher; Alan Swabey; Robert E. Mitchell

[57] ABSTRACT

The invention relates to a heating element for a heated chair which can be used as a covering material for the heated chair or which can be laid under the covering material or which can be draped over an ordinary chair to convert it to a heated chair. In accordance with the invention, the heating element has a glass fibre fabric layer made of intermixed glass fibre strands. An electrical resistance wire which consists of a core of glass fibre strands with a resistive wire wound around it, forms an undulating pattern in the glass fibre fabric layer, and top and bottom layers of thermoplastic material are heat fused or adhesively laminated to the glass fibre fabric layer. A metallic foil layer is applied to the side of the bottom layer which is remote from the glass fibre fabric layer. The heating element also includes a control for controlling the power delivered to the resistance wire. The said control is a simple dual proportional control which regulates the energy usage of the heating element.

7 Claims, 2 Drawing Figures

HEATING SYSTEM FOR CHAIRS

BACKGROUND OF INVENTION

1. Field of the Invention

The invention relates to a flexible heating element. More specifically, the invention relates to such a flexible heating element as either the type which can be used as the covering material for a heated chair or the type which can be disposed under the covering material, or the type which can be draped over an ordinary chair to transform it to a heated chair. The invention also relates to a dual proportional control means for controlling the power flow through the heating element.

2. Description of Prior Art

Heated chairs are known in the art as shown, for example, in the Volvo Brochure Parts Manual 1975. As will be appreciated, with heated chairs in a household, the ambient temperature of the house can be kept down since when a person is seated, he will be heated by the heated chair. When he is up and moving about, he does not require as much heat since his own body will be producing heat to warm him. Thus, the presence of heated chairs in a household can be energy conservative. Presently available heated chairs were provided for comfort only, and were therefore not designed to maximize energy conservation.

It is also known to provide flexible heating elements as described in U.S. Pat. No. 4,044,221, Kuhn, Aug. 23, 1977. However, this element of Kuhn is relatively bulky and is meant for installing in new seats. It can not be used as a covering material for a chair, or draped over an existing chair.

Heat responsive control circuits, for example, for electrically heated blankets, are also known in the art as described in Canadian Pat. Nos. 777,289, Wray, Jan. 30, 1968 and 868,615, Naoi et al, Apr. 13, 1971, as well as U.S. Pat. Nos. 3,422,244, Lauck, Jan. 14, 1969 and 3,564,203, Naoi et al, Feb. 16, 1971. The "General Electric SCR Manual, 4th Edition 1967" also illustrates a heat responsive control circuit on pages 186 to 189. However, none of these said heat responsive control circuits is a dual proportional control. None of these heat responsive controls can be variably set to regulate both (i) the firing angle of a triac determining the average power flowing through the load and (ii) the range of duty cycles (i.e. on off periods) dependent upon the rate of cooling determined by the ambient room temperature. None of these said heat responsive control circuits can provide the variety and degree of comfort control and saving of energy.

SUMMARY OF INVENTION

It is therefore an object of the invention to provide a flexible heating element which can be used either as a covering material for a chair or which can be draped over an existing chair, or which can be disposed under the covering material.

It is a further object of the invention to provide such a flexible heating element with a control means having dual control over both the average power delivered to the heating element and the range of duty cycles of the heating element.

In accordance with the invention, there is provided a flexible heating element which comprises: a glass fibre fabric layer made of intermixed glass fibre strands; electrical resistance wires in said glass fibre fabric layer and defining a regular pattern in said glass fibre fabric layer; a top layer of a thermoplastic material on one side of said glass fibre fabric layer; a bottom layer of a thermoplastic material on the other side of said glass fibre fabric; and a metallic foil layer applied to the bottom layer on the side remote from the said glass fibre fabric layer; characterized in that said top layer, said bottom layer and said metallic foil layer are heat fused or adhesively laminated to said glass fibre fabric layer.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
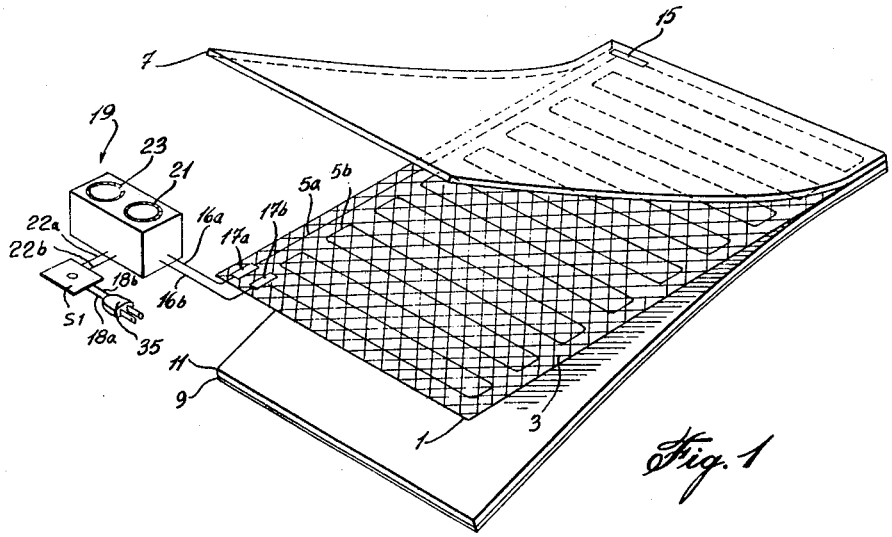
FIG. 1 is an exploded isometric view of the inventive heating element.

Referring now to FIG. 1, the heating element comprises a glass fibre fabric layer 1 made of intermixed glass fibre strands 3. The strands may be either matted in a semiregular pattern or woven in a regular pattern. Resistance wires 5*a* and 5*b*, are arranged in a regular pattern preferably with 5*b* undulating in the layer 1. They would be intermatted in the layer 1 when the layer comprises a matted layer, and interwoven when the layer comprises a woven layer. In either case, they would form an integral part of the layer 1.

Both the wires 5*a* and 5*b* are composed of an insulating core of glass fibre, similar to strands 3, around which is wound, in a helical path, an electrically resistive wire preferably made of a nickel-iron alloy such as the alloys identified by the trade marks Nichrom or Chromalloy.

The top and bottom layers of the heating element, 7 and 11 respectively, consist of thermal plastic sheets and each of the sheets may have the following properties: Electrically insulating to 275 volts at the operating temperature of 41° C. (105° F.); flexible; moisture resistant; 0.5 to 2.0 mm thickness; composed of cross-linked polyethylene or poly-vinyl-chloride.

The bottom layer 11 also includes a layer of metallic foil 9, such as aluminum foil, to reflect the radiant heat upwards.

Although the layers are shown separated (exploded isometric) in FIG. 1, they are actually heat fused, or adhesive-laminated, to the middle layer 1 to form an integral, and very thin, sheet which can be used to form the covering material for a heated chair, or which can form a sheet for draping over an ordinary chair to transform it to a heated chair, or which can be disposed under the covering material of the chair.

Metallic mesh or foil connector terminals 17*a* and 17*b* are connected at one end of the heating element to the respective ends of wires 5*a* and 5*b*, and at the other end of said heating element, the ends of the wires 5*a* and 5*b* may be joined together by mesh or foil connector terminal 15. Conductor leads 16*a* and 16*b* extend from the respective terminals 17*a* and 17*b* to the outside of the element. The conductor leads of one or more heating elements may be connected to housing 19 which includes controls 21 and 23 whose function will be described in the discussion of FIG. 2. Subsequently the conductor leads 22*a* and 22*b* are connected to switch S1 which may be either a pressure activated microswitch or a manual switch integral in the exterior of housing 19.

Figure 2:
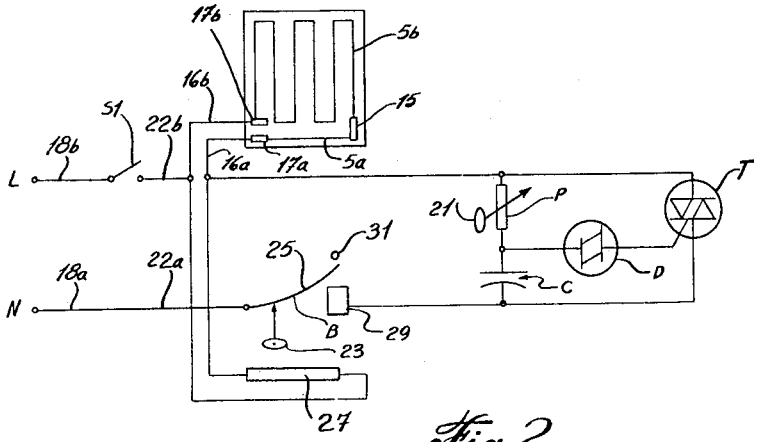
FIG. 2 is a circuit diagram of the inventive control means.

In operation, the switch S1 is preferably a microswitch disposed under the seat area of the element so that the pressure of a person sitting on a chair in which the element is disposed will automatically actuate the switch to turn on the element as will be apparent in the consideration of FIG. 2. When the person gets off the chair, the release of pressure will cause the switch S1 to be deactivated so that the element is automatically turned off when it is no longer needed. Finally, the respective conductor leads 18*a* and 18*b* are connected to plug 35, which can be plugged into a wall socket to provide power to the element.

Turning now to FIG. 2, the control circuit includes the switch S1 which, when turned on, will permit power to flow to the load 5*a* and 5*b*, illustrated schematically in FIG. 2. In circuit with the load 5*a* and 5*b* is the bimetallic switch B which, as well known in the art, consists of two adjacent strips of metal having different coefficients of heat expansion which form a single strip 25. When the bimetal switch 25 is exposed to a predetermined degree of heat, it will bend upwardly away from the terminal pad 29 toward contact 31. The position of the entire bimetallic switch 25 with respect to the terminal pad 29 is adjustable by means schematically represented at 23 in FIG. 2. The means 23 could be a screw-adjustable fulcrum for strip 25 for example.

As the entire bimetallic strip 25 is moved toward the edge of the pad 29, a smaller change in temperature is required to move the free end of it off the pad in the direction of contact 31.

Included as part of the bimetallic switch, and mounted on the strip 25 in a resistor 27. As can be seen, the current which flows through 27 is proportional to the current which flows through the load 5*a* and 5*b*. Thus the bimetallic switch measures, and is controlled by, the heating power in the heating element.

When strip 25 is off the pad 29, current will no longer flow through the load 5*a* and 5*b* or the resistor 27, and the resistor 27 will now cool down so that strip 25 will also cool down and straighten out to return to pad 29. As the housing 19, in which the bimetallic switch is disposed, is outside the heating element, the cooling rate of the resistor and of the strip 25 is determined by the ambient temperature. The rate at which B opens and closes, i.e. its duty ratio, is determined by the setting of 23, the setting of 21 (as will be discussed below) and the ambient temperture of the air surrounding the control, so that the average power delivered to load 5*a* and 5*b* is a function of both the average power setting (on 21), and the ambient room temperature.

The control circuit also includes a variable impedance, such as variable resistor 21 (preferably a linear potentiometer, P) and a capacitor C connected to each other in series. Connected to the junction of the resistor and capacitor is one end of a diac D whose other end is connected to the control terminal of a triac T. The value of the resistance of 21 and the capacitance of C determines the firing angle of the triac, and this value is, of course, variable by adjustment of 21. As well known in the art, the triac will conduct through a greater or lesser part of each period of an AC cycle applied thereto depending on the firing angle of the triac. As power flows through the load 5*a* and 5*b* only when the triac is conducting, the firing angle set by the RC circuit (by adjusting 21) will determine the average power setting of the element. The average power actually delivered to the load will, of course, be modified by the duty ratio of the bimetallic switch B.

The diac is provided for full wave power control as discussed in the General Electric SCR Manual, supra.

In operation, the heating element is made thin enough so that it can comprise either the covering material of a heated chair or it can be formed separately to be draped over an ordinary chair or it can be disposed under the covering material. In all cases the switch S1 may be disposed either on the setting area of the chair or on the outside of control housing 19. The control means is disposed so that it is convenient to a user. When a person sits on the chair, he automatically turns on the heating element, and when he gets up, he automatically turns it off.

The heat level of the heating element is set by the dual controls 21 and 23 as discussed above. In operation, the average power flow through the load is first adjusted by control 21 until the user feels an agreeable level of heat intensity. Then control 23 is adjusted to give the user an agreeable duty ratio of heat-on and heat-off, and that ratio will also be sensitive to the ambient room temperature.

It will be obvious that a heating unit can consist of one heating element and one control. Alternatively, it can consist of the same single control connected with a plurality of heating elements. In the latter case, the heating elements may be connected in parallel with each other.

Although a single embodiment has been described, this was for the purpose of illustrating, but not limiting the invention. Various modifications, which will come readily to the mind of one skilled in the art, are within the scope of the invention as defined within the scope of the appended claims.

I claim:

1. A flexible heating element comprising:

a fibre fabric layer made of intermixed glass fibre strands;

electrical resistance heating wires in said fibre fabric layer and defining a regular pattern in said fibre fabric layer;

a top layer of a thermoplastic material on one side of said fibre fabric layer;

a bottom layer of a thermoplastic material on the other side of said fibre fabric layer; and a metallic foil layer applied to the bottom layer on the side remote from said fibre fabric layer;

said bottom layer and said metallic layer being fused to said fibre fabric layer, and said top layer being fused with said bottom layer, whereby said top and bottom layers enclose said glass fibre fabric layer and said electrical resistance means to form an integral laminated sheet;

and further comprising means for connecting said resistance heating wires to a source of electrical power;

said means for connecting said resistance heating wires comprising terminals connected to said heating resistance wires and extending out of said laminated sheet;

control means in said connecting means for controlling power delivered to said resistance wire, and wherein said control means comprises a first control for setting a power level; and a bimetallic switch;

said bimetallic switch being controlled by said power level and ambient temperature of air surrounding said control means;

whereby a comfort level is set by said first control and a duty ratio, sensitive to ambient temperature, is set by said bimetallic switch.

2. A heating element as defined in claim 1 wherein said electrical resistance wires comprise an insulating core of glass fibre and a resistive wire wound around said core in a helical path.

3. A heating element as defined in claim 2 wherein said top and bottom layers are made of a material which is electrically insulating to 275 volts, and wherein the thickness of each said layer is 0.5 to 2.0 mm.

4. A heating element as defined in claim 3 wherein said glass fibre fabric layer is made of said glass fibre strands matted in a semi-regular pattern, and wherein said electrical resistance wire is intermatted in said glass fibre strands in an undulating pattern.

5. A heating element as defined in claim 3 wherein said glass fibre fabric is made of said glass fibre strands, woven in a regular pattern and wherein said electrical resistance wire is interwoven in said glass fibre strands in an undulating pattern.

6. A heating element as defined in any one of claims 4 or 5 and further comprising means for connecting said resistance wire to a source of electrical power; and control means in said connecting means for controlling power delivered to said resistance wire.

7. A heating element as defined in claim 1 and further comprising an ON/OFF switch comprising a microswitch.

* * * * *